United States Patent [19]

List et al.

[11] Patent Number: 4,575,253

[45] Date of Patent: Mar. 11, 1986

[54] STIRRING APPARATUS

[75] Inventors: Jörg List, Pratteln; Alfred Kunz, Witterswil, both of Switzerland

[73] Assignee: Dipl. Ing. H. List, Industrielle Verfahrenstechnik, Pratteln, Switzerland

[21] Appl. No.: 554,551

[22] Filed: Nov. 22, 1983

[30] Foreign Application Priority Data

Nov. 26, 1982 [CH] Switzerland ..... 6904/82

[51] Int. Cl.[4] ..... B01F 7/04

[52] U.S. Cl. ..... 366/331; 366/325; 415/135; 416/241 B; 464/79

[58] Field of Search ..... 366/147, 325, 312, 313, 366/349, 331, 169, 199, 251, 97, 98, 99, 100, 279; 415/135; 416/241 B; 464/79, 80

[56] References Cited

U.S. PATENT DOCUMENTS

| | | | |
|---|---|---|---|
| 2,027,185 | 1/1936 | Loomis | 366/147 |
| 2,116,099 | 3/1938 | Chamberlain | 366/325 X |
| 2,811,339 | 10/1957 | Osborne et al. | 416/241 B X |
| 3,156,452 | 11/1964 | Touzalin et al. | 366/147 |
| 3,326,534 | 6/1967 | Pryde | 416/241 B X |
| 3,751,010 | 8/1973 | Latinen | 366/328 X |
| 3,922,146 | 11/1975 | Kupka | 366/279 X |
| 4,067,553 | 1/1978 | Yamaoka | 366/147 X |
| 4,264,215 | 4/1981 | Nunlist et al. | 366/279 |
| 4,312,599 | 1/1982 | Darolia | 416/241 B X |
| 4,383,768 | 5/1983 | Kupka | 366/279 |

FOREIGN PATENT DOCUMENTS

| | | | |
|---|---|---|---|
| 1026405 | 4/1953 | France | 366/331 |
| 1250984 | 10/1971 | United Kingdom | 366/313 |
| 143372 | 1/1962 | U.S.S.R. | 416/241 B |

*Primary Examiner*—Philip R. Coe
*Assistant Examiner*—Frankie L. Stinson

[57] ABSTRACT

The stirrer vessel and stirrer shaft of a stirring apparatus are heated and carry an enamel coating on the surfaces coming into contact with the product. In order to prevent destruction of this enamel coating when the stirrer shaft is severely stressed, elastic intermediate members are arranged between a rigid support shaft and a shaft casing. The stuffing box is also held on the stirrer vessel by a further elastic intermediate member. An elastic packing between the fixed part of the stirrer vessel and the vessel cover fixed to the drive casing balances forces which are transferred from the vessel wall to the drive casing.

8 Claims, 5 Drawing Figures

STIRRING APPARATUS

BACKGROUND OF THE INVENTION

The invention relates to a stirring apparatus with a stirrer having a hollow shaft and which is surrounded by a fixed casing and a drive means for the stirrer, wall parts of the casing and/or holow shaft being heatable.

As products to be stirred may have a corrosive action, particularly at high temperatures, known stirring apparatuses of the indicated type must be made from highgrade, stainless steel. To protect against corrosion, it is generally known to coat heated containers with an enamel coating, but as is known, such a protective coating can only be applied to wall parts having a limited thickness and it is destroyed due to its limited elasticity or percussion/impact sensitivity, when the wall part provided with the protective coating is exposed to loads or stresses, which lead to an elastic deformation thereof. It is therefore not possible to use impact-sensitive protective coatings for stirring apparatuses in which considerable stirring forces, due to high viscosity, are to be expected.

BRIEF SUMMARY OF THE INVENTION

The problem of the present invention is to find a stirring apparatus of the aforementioned type for high torques, which is provided with wall parts having an impact-sensitive protective coating, while, in order to reduce the manufacturing costs for the apparatus, these wall parts can be made from non-stainless steel. This problem is sloved by providing the wall parts of the casing and the stirrer coming into contact with the product to be stirred with an impact-sensitive protective coating and by accomplishing the force transfer between such wall parts and adjacent apparatus parts by means of at least one elastic intermediate member or interconnection.

As a result of the features according to the invention, forces acting locally on a wall part do not lead to a corresponding local material stress, and therefore to the destruction of the protective coating. Because of the use of elastic intermediate members or interconnections, the forces are uniformly distributed over the adjacent apparatus parts.

BRIEF DESCRIPTION OF THE DRAWINGS

The invention is described in greater detail hereinafter relative to non-limitative embodiments and the attached drawings, wherein.

DETAILED DESCRIPTION OF THE INVENTION

Figures 1, 2:
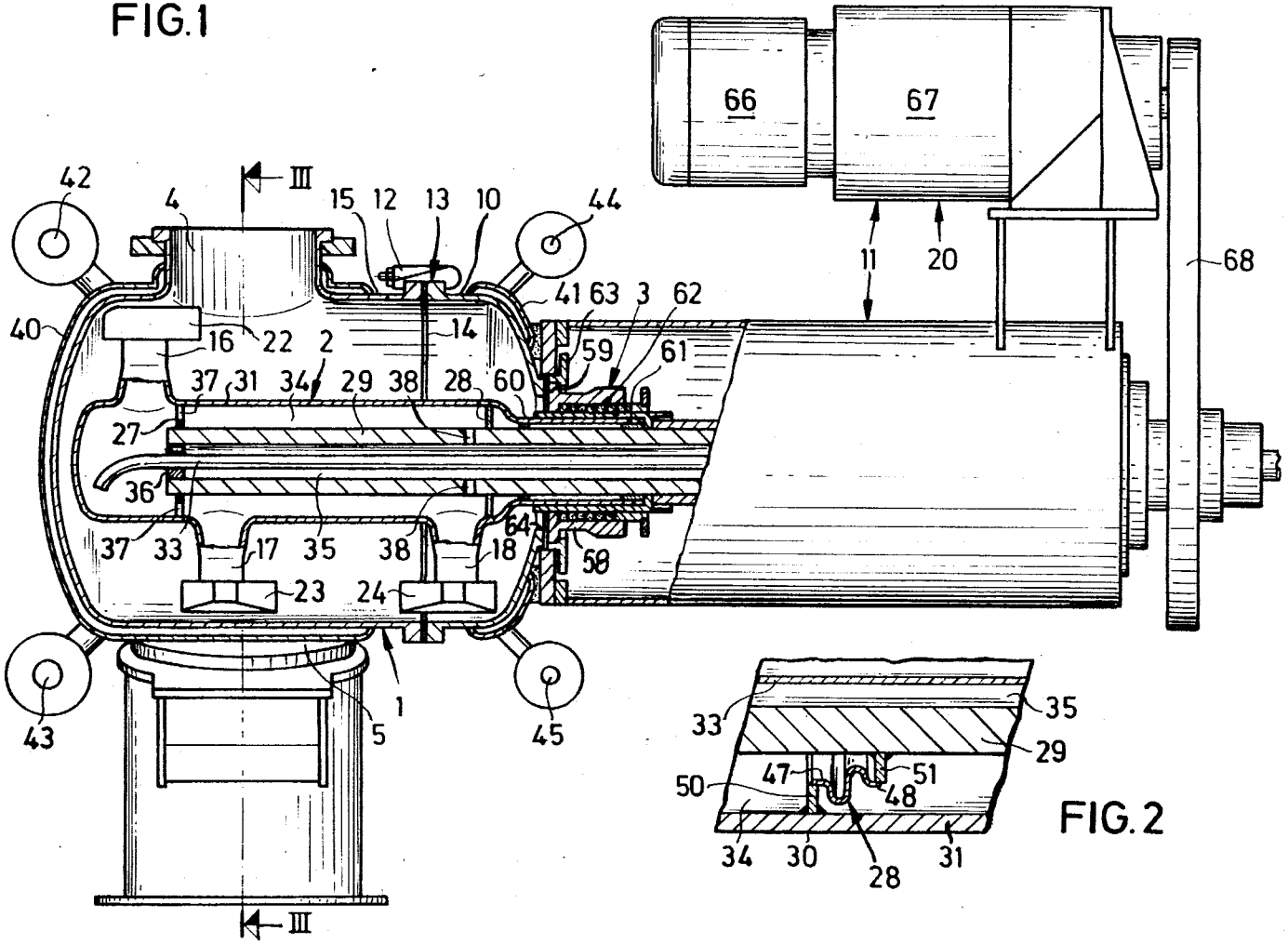
FIG. 1 is a partly axial-sectional side view of a stirring apparatus, according to the invention.
FIG. 2 is a larger scale axial partial section through the stirrer shafts of the apparatus with an embodiment of an elastic intermediate member between a shaft casing and an inner support shaft.
Figure 3:
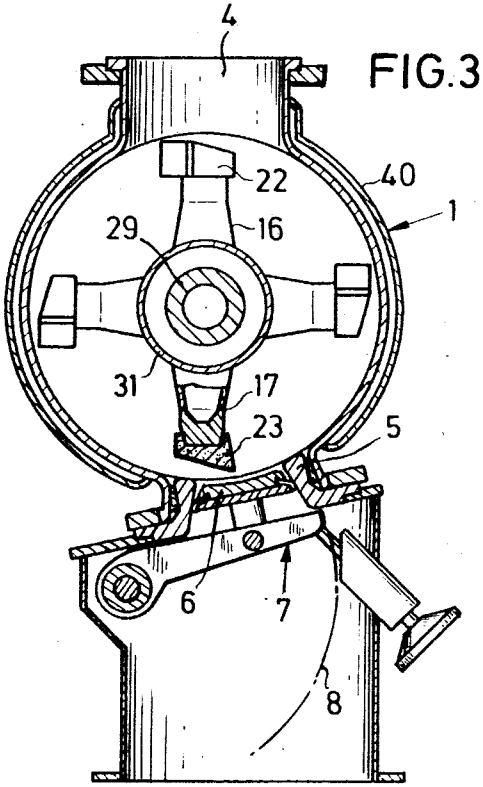
FIG. 3 is a cross-section taken along line III—III of FIG. 1.

The stirring apparatus according to FIGS. 1 to 3 has a stirrer vessel 1 which has its longitudinal axis arranged horizontally and which surrounds a coaxially arranged stirrer shaft 2. Unlike in the embodiment according to FIG. 5, the stirrer shaft 2 is only mounted on one side and is consequently only passed through a stuffing box 3 on one side of vessel 1. The stirrer vessel 1 is fixed and has on its top surface a filling connection 4, which enables vapors to be removed. An emptying connection 5 at the bottom of vessel 1 surrounds a conically inserted gas-tight cover or lid 6 (FIG. 3), which can be swung downwards by means of an actuating device 7, as indicated by the curved dot-dash line 8.

The right-hand part of the stirring apparatus in FIG. 1, as well as a stirrer vessel cover 10 and a drive casing 11 connected thereto, can be moved away from the stirrer vessel 1 together with stirrer shaft 2, after releasing screw clamps 12 of a flanged connection 13. For this purpose, the apparatus apart can be movably positioned on rails in a manner not shown. Flanged connection 13 encloses a semi-elastic and relatively thick packing 14, which forms an elastic intermediate member or interconnection between drive casing 11 and a fixed vessel part 15. Packing 14 prevents that, in the case of a suddenly occurring force-closure, a corresponding sudden load peak has to be absorbed in an undamped manner in the stirrer shaft 2 or its stirring arm 16, 17, 18 and stirrer vessel 1, because the forces emanating from the shaft 2 must be transferred from the vessel 1 to the drive casing 11, which carries the drive of stirrer shaft 2.

Figure 4:
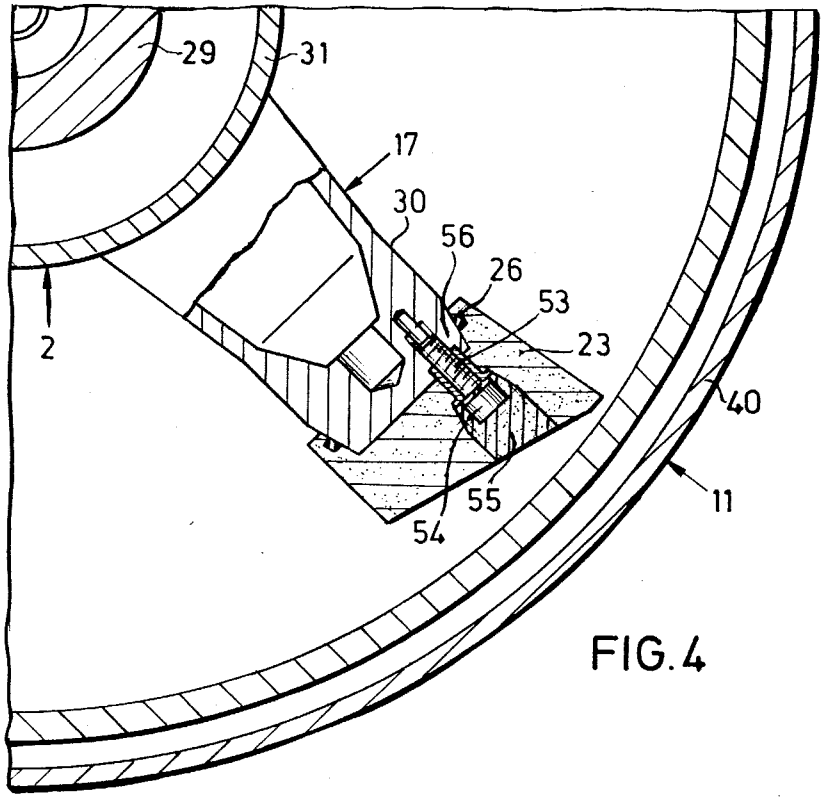
FIG. 4 is a larger scale 90° partial section with a stirring arm.

As in the case of load peaks during the stirring of lumpy and/or oily viscous products, sudden stresses also occur on the stirrer shaft 2 and emanate from the stirring blades 22, 23, 24, elastic intermediate members or interconnections are also provided on the force path from the stirring blades to the moved part of drive 20, in accordance with an elastic insert 26 on the stirring blade, shown in FIG. 4, and metallic spring bellows 27, 28 between a relatively rigid, hollow support shaft 29 and a shaft casing 31 carrying an enamel coating 30.

The subdivision of the stirrer shaft 2 into a relatively rigid, inner hollow shaft 29, which absorbs the bending forces, and a shaft casing 31 spaced therefrom, makes it possible to provide that part of shaft 2 arranged in stirrer vessel 1 with the enamel coating 30, because in this way the shaft casing can be correspondingly constructed in a relatively thin-walled manner. Without the aformentioned elastic intermediate members 27, 29, deformations could be caused by the stirring forces in shaft casing 31 and this would lead to the fracture of the enamel coating. A pipe 33 carrying a heating medium is passed through the hollow support shaft 29 and is passed into a heating medium in an area 34 between support shaft 29 and the enamelled shaft casing 31. The return flow of the heating medium takes place through a cross-sectionally annular area 35 between the heating medium pipe 33 and support shaft 29. In order to permit this flow guidance, openings 37 and 38 are provided respectively in elastic intermediate member 27 and in support shaft 29 in front of intermediate member 28.

To permit the heating of the stirrer vessel 1, outside the region of flanged connection 13, the vessel is provided with heating jackets 40, 41, to which are connected supply and discharge lines 42, 43 or 44, 45.

FIG. 2 shows an embodiment for the support between support shaft 29 and shaft casing 31 by means of an elastic intermediate member constructed as a spring bellows. This metallic spring bellows permits, as a result of its cross-sectionally corrugated shape, a relatively large elastic deformation, both in axial and in radial direction of the shaft. The two axial ends 47, 48 of spring bellows 28 are in each case fixed to a thrust ring 50 or 51 respectively, which in turn is welded to the shaft casing 31 or the support shaft 29, respectively.

FIG. 4 shows in a relatively large scale cross-sectional view, the arrangement of a stirring blade 23 on a stirring arm 17 of stirrer shaft 2. Stirring arm 17 is coated with an enamel coating 30, whereas stirring blade 23 is itself formed from a corrosion-resistant and wear-resistant material. Stirring blade 23 is screwed to stirring arm 17 by means of one or more screws 53, while the screw head 54 of each screw 53 is located in a countersunk hole, which is filled with a corrosion-proof sealing compound 55. Stirring blade 23 surrounds the tapering outer end 56 of stirring arm 17, and the elastic insert 26 between said stirring arm end and the stirring balde 23 prevents damage to the enamel coating 30 and simultaneously seals the gap between stirring arm 56 and stirring blade 23. In addition, casing 58 of stuffing box 3 is connected by means of an elastic intermediate member 59 to the stirrer vessel 1, so that stresses enamating from the shaft 2 and acting in a shock-like manner on stuffing box 3 are damped or compensated and cannot lead to an overloading of enamelled areas of the stirring apparatus. A corrosion-proof sleeve 61 is mounted and fixed on the tapered end 60 of shaft casing 51 and it is also possible to insert an elastic packing (not shown) in the area of the leading edge of said sleeve between the two parts. The stuffing box packing 62 engages on the outside of sleeve 61. A flange 63 presses the stuffing box casing 58 against the elastic intermediate member 59, which is constructed as a sealing washer, and therefore against an opening edge 64 of stirrer vessel 1.

Stirrer shaft 2 is driven by drive 20 fitted laterally to the stirring apparatus, from an electric motor 66 via a gear 67 and a drive transmission enclosed in a casing 68 and which e.g. comprises V-belts.

Figure 5:
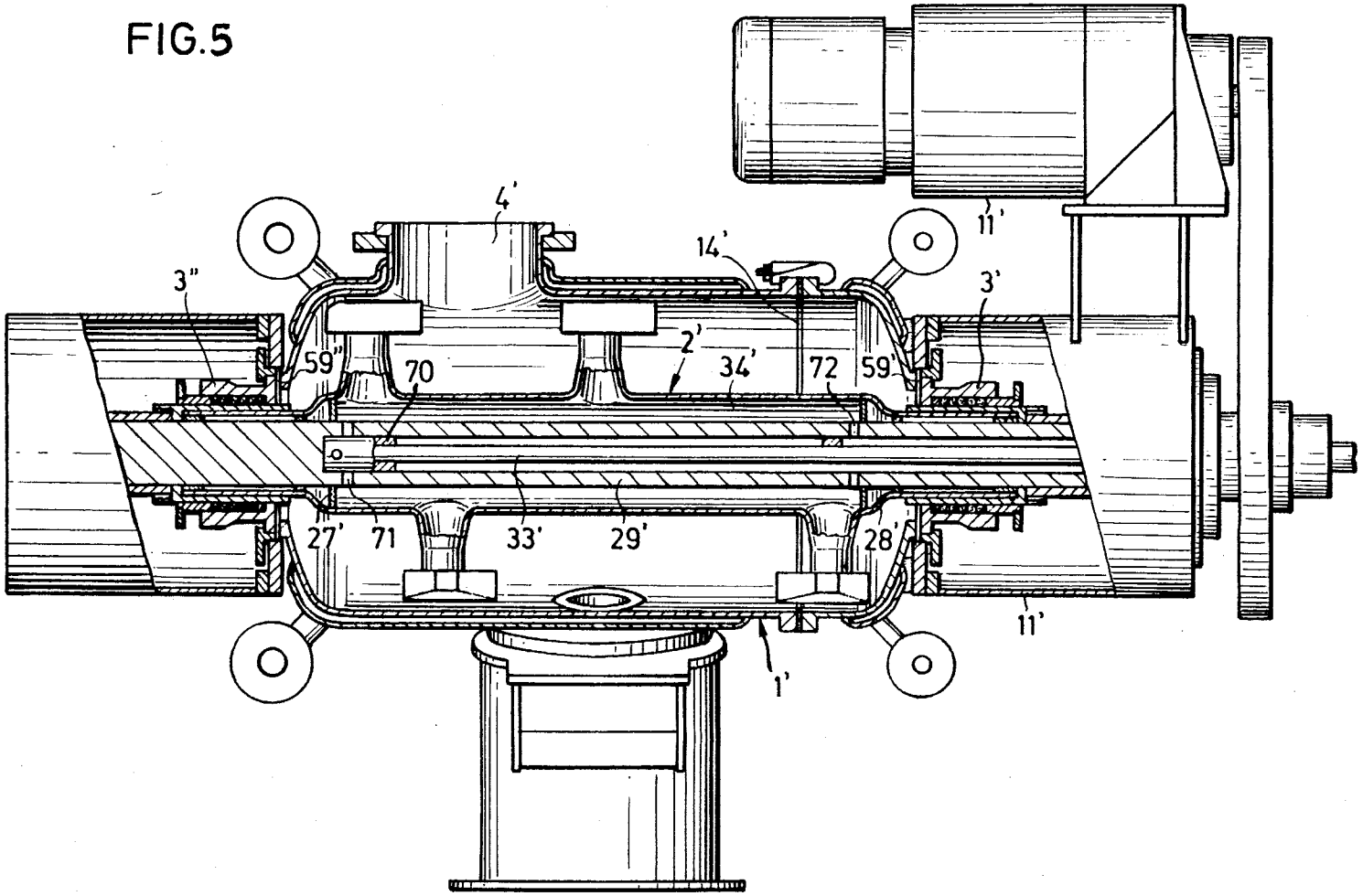
FIG. 5 is a stirring apparatus with a double-mounted stirrer shaft.

The embodiment of FIG. 5 differs from the aforementioned embodiment essentially only through the two-sided mounting of stirrer shaft 2', so that the latter is exposed to smaller bending forces. However, the aforementioned embodiment has shown that, as a result of the present invention, the stirrer shaft can also be mounted on one side only. The stuffing box construction 3', 3'' are constructed in accordance with the aforementioned stuffing box construction 3. Heating medium is supplied by stirrer shaft 2', from heating medium jacket 33'. As the annular gap between the heating medium duct 33' and shaft 29' is blocked by a ring 70, the heating medium passes through bores 71 into the heating medium area 34' between support shaft 29' and stirrer shaft 2'. The return flow of the heating medium from area 34' is by means of radial bores 72 in support shaft 29'. Other parts of the stirring apparatus according to FIG. 5, which correspond to parts of the previously described stirring apparatus, are indicated by reference numerals followed by apostrophes.

What is claimed is:

1. A stirring apparatus comprising:

a drive means;

a two-part stirring shaft including a hollow casing having a plurality of stirring arms affixed thereto and an impact sensitive protective coating thereon and a hollow shaft positioned within said casing and connected to said drive means to be rotated by said drive means;

force transmitting means connecting said hollow shaft to said casing for causing said stirring arms to be rotated by said drive means and for isolating said casing from said hollow shaft during sudden load peaks applied to said stirring arms whereby loading stress associated with such load peaks is not transmitted to said impact sensitive protective coating, said force transmitting means including first flexible means connecting each stirring arm to a stirring blade thereon, second flexible means connecting said casing to said hollow shaft at one location and third flexible means connecting said casing to said hollow shaft at a second location spaced from said first location, said second and third flexible means permitting movement of said hollow shaft relative to said casing to that said hollow shaft and said casing can rotate at different speeds.

2. A stirring apparatus according to claim 1, wherein said drive means comprises a housing fixed to a part of said stirring apparatus casing, a semi-elastic packing of a flanged connection connecting said housing with the stirring apparatus casing.

3. A stirring apparatus according to claim 1 including a stuffing box sealing around said hollow shaft, and a semi-elastic packing connecting the housing of the stuffing box with the stirring apparatus casing.

4. A stirring apparatus according to claim 3, wherein the part of the stirrer shaft passed through the stuffing box is surrounded by a corrosion-proof sleeve.

5. A stirring apparatus according to claim 1, wherein the stirrer shaft has a free end enclosed in the stirring apparatus casing.

6. A stirring apparatus according to claim 1, wherein the force transmitting means each are metallic spring bellows.

7. A stirring apparatus according to claim 1, said stirring blades are respectively detachably fixed to said stirring arms, and are made of a corrosion-proof material, elastic inserts being provided between the respective stirring arm and the stirring blade.

8. A stirring apparatus according to claim 7, wherein each stirring blade has a surface surrounding a tapering free end of the stirring arm, and the first flexible means is provided on said surrounding surface.

* * * * *